United States Patent [19]

Brambley et al.

[11] 4,271,965

[45] Jun. 9, 1981

[54] CONTAINER FOR FILM PROCESSING CHEMICALS

[75] Inventors: Michael I. Brambley, Mount Laurel; Herbert J. Myers, Maple Shade; Januario R. Rios, Jr., Cherry Hill, all of N.J.

[73] Assignee: Picker Chemicals Inc., Cherry Hill, N.J.

[21] Appl. No.: 929,174

[22] Filed: Jul. 28, 1978

[51] Int. Cl.[3] ..... B65D 25/08

[52] U.S. Cl. ..... 206/219; 206/459; 206/578; 354/297; 220/23.2; 220/23.4

[58] Field of Search ..... 220/23.2, 23.4; 206/459, 219, 578; 354/323, 297, 328

[56] References Cited

U.S. PATENT DOCUMENTS

| | | | |
|---|---|---|---|
| 1,179,056 | 4/1916 | Walsh | 206/216 |
| 3,000,134 | 9/1961 | Marini | 220/23.4 |
| 3,194,426 | 7/1965 | Brown, Jr. | 220/23.4 |
| 3,225,951 | 12/1965 | Poston et al. | 220/23.4 |
| 3,326,531 | 6/1967 | Matheson . | |
| 3,358,821 | 12/1967 | Weisberg | 206/459 |
| 3,658,204 | 4/1972 | Boettger . | |
| 3,705,598 | 12/1972 | Ray . | |
| 3,756,471 | 9/1973 | Wissman . | |
| 3,933,268 | 1/1976 | Buske . | |
| 3,994,408 | 11/1976 | Belitzky . | |
| 4,003,491 | 1/1977 | Wells et al. . | |
| 4,103,358 | 7/1978 | Gacki et al. | 366/177 |

OTHER PUBLICATIONS

Research Disclosure Publication No. 11440, Oct. 1973.

"Operating Instructions" Kodak Supermatic 8 Processor, dated Jun. 1974.

*Primary Examiner*—Joseph Man-Fu Moy

*Attorney, Agent, or Firm*—Watts, Hoffmann, Fisher & Heinke Co.

[57] ABSTRACT

A container system, including a carrier and a lightweight, disposable container, for storing and dispensing film processing chemicals. Different carrier and container configurations create a system in which a particular container can be used only with a particular carrier. The container includes a plurality of individual bottles, each for holding a different film processing chemical. One of the bottles is considerably larger than the others and includes a handle portion to facilitate positioning the container into the carrier which in turn is usable in a film processing machine. The bottles are held together by an interlocking mortice/tenon and the bottles are preferably retained in place by a wrapper adhered to a portion of the external surface of the container.

8 Claims, 8 Drawing Figures

CONTAINER FOR FILM PROCESSING CHEMICALS

REFERENCE TO RELEVANT PATENT

U.S. Pat. No. 4,103,358, Fluid Mixing and Dispensing System, issued July 25, 1978, to Leonard W. Gacki and Robert E. Daly, here the "Mixer Patent," the disclosure of which is incorporated by reference.

BACKGROUND OF THE INVENTION

1. Field of the Invention

The invention relates to a container system for film processing chemicals and, more particularly, to an improved container and a carrier-container combination in which film developer chemicals can be dispensed only into a developer processing mechanism and film fixer chemicals can be dispensed only into a fixer processing mechanism.

2. Description of the Prior Art

Reference is made to the Mixer Patent for a detailed explanation of the difficulties associated with mixing film processing chemicals and for a technique which overcomes these difficulties. In that patent, an improved technique for expeditiously mixing film processing chemicals is disclosed wherein a plurality of bottles, each of a different size and containing a different film processing chemical, are disposed within a carrier body. The bottles include openings which are accessible through a portion of the carrier body so that the bottles may be opened by the film processing machinery.

The carriers conveniently protect the bottles and permit the bottles to be easily stored and transported as well as dispensed. Because the bottles contain a premeasured quantity of film processing chemicals in the proper strength, operator error is eliminated and repeatable, accurately proportioned mixtures of film processing chemicals are obtained. This makes mixing film processing chemicals much easier than before, and smaller batches of chemical mixtures can be conveniently prepared on a more frequent basis, if need be. In turn, it is easier to maintain fresh film processing chemicals so the quality of the resultant film product consistently is higher.

Although this technique is highly effective, it has certain shortcomings. Because different quantities of film processing chemicals are required, the bottles needed to house the chemicals must be of different sizes. It is expected that cartons containing quantities of the different-sized bottles will be stored by the operator for individual replenishment into the carriers. It is possible that one of the bottles could be overlooked during a carrier reloading operation and an improper mixture of film processing chemicals then could be delivered to the film processing machinery. Even though such an improper mixture of chemicals is unlikely, it still is a possibility and, accordingly, the system is not completely fool-proof.

An additional concern is that when the bottles are disposed within a carrier, either different-sized containers are required to hold the bottles in place or a cover included with the carrier must include structure, such as stepped projections, to retain the bottles securely in proper position for use. The overall size of the carrier is somewhat bulky considering the quantity of film processing chemicals contained within the carrier.

SUMMARY OF THE INVENTION

The present invention provides improved carriers and associated low-cost containers for storing and dispensing film processing chemicals. Because of the low-cost nature of the containers, they can be discarded after a single use. Moreover, the carriers and containers include built-in interlocks to provide a fool-proof system which avoids improper mixing of chemicals.

Essentially, each container is a composite structure which includes a plurality of individual bottles, each for housing a different film processing chemical, with each bottle having an opening for discharge of the chemical from the bottle. The bottles are connectable to each other so that the bottles may be held together in a unitary, self-supporting assembly. The bottles are configured appropriately so that when the bottles are assembled, the exterior surface of the assembled container forms a shape generally that of a rectangular prism. This shape facilitates stacking and handling of the containers.

A strong, secure connection between bottles is made by an interlocking mortice/tenon. In order to prevent the bottles from becoming disengaged during handling and to provide identification of container contents, and so forth, a wrapper is adhered to a portion of the exterior surface of the container. The wrapper essentially comprises a strong piece of paper or plastic having cement on one surface. The wrapper overlaps a portion of the interface between adjacent bottles to hold the bottles together securely.

A preferred container embodiment utilizes three bottles, one of the bottles being much larger than the others and centrally disposed with respect to the other bottles. The large bottle includes recessed portions into which the other bottles may be fitted and secured in place. The recessed portions are symmetrically disposed about a vertical, central plane extending through the large bottle and the recessed portions form an exterior surface of the large bottle standing alone, so that the other bottles, when in place, form an exterior surface of the assembled container. The large bottle is provided with strengthening ribs which may take the form simply of extended indented portions. This permits a lighter-gauge material to be used than otherwise would be required and conserves manufacturing expense and material. The large bottle also is provided with an indented portion to permit the container to be gripped and maneuvered into place on the film processing machinery.

A separate carrier is provided for each container. The carrier includes an interface member engageable with film processing machinery to serve as an interface between the container openings and the film processing machinery. One interface member is provided for a film fixer mixing machine and a different interface member is provided for a film developer mixing machine; the two members are so constructed that they cannot be interchanged on the respective machines. In particular, the fixer and developer interface members are distinguished by different projections that engage mating recesses on the respective fixer and developer mixing machines. This construction is shown in the Mixer Patent.

Each carrier also includes a cover matable with the interface member only when an appropriately configured container is fitted into the carrier. That is, a cover usable only with the fixer interface member permits only a fixer chemical-containing container to be fitted into that carrier; similarly, a cover usable only with the developer interface member permits only a developer chemical-containing container to be fitted into that carrier.

A feature that prevents inadvertent confusion among the covers and containers is a greater exterior dimension of one of the containers relative to the other. Also, the container having the greater exterior dimension and the cover associated with that container include a discriminating system. Although the discriminating system can be provided in different forms, in the embodiment illustrated, one of the containers is taller than the other so that it can be used only with a particular carrier cover. The taller container also includes a slot which engages a projecting rib in its mating carrier cover. By this construction, the other container (the shorter one) cannot be used with the taller container's cover, and the taller container cannot be used with the shorter container's cover because the shorter container's cover then could not be locked into place on the interface member.

In addition to the obvious advantages arising from the interlock construction, other advantages also accrue. For example, retainers in the carriers no longer are needed and it has been found that more chemicals can be carried in less volume than heretofore possible. Further, the space requirements for storing and dispensing a given quantity of film processing chemical are decreased with obvious attendant advantages from the standpoints of storage space and overall film processing machinery size.

Additional advantageous features of the invention will become apparent from the following detailed description of a preferred embodiment of the invention made with reference to the accompanying drawings which form a part of the specification.

DESCRIPTION OF THE PREFERRED EMBODIMENT

Figure 1:
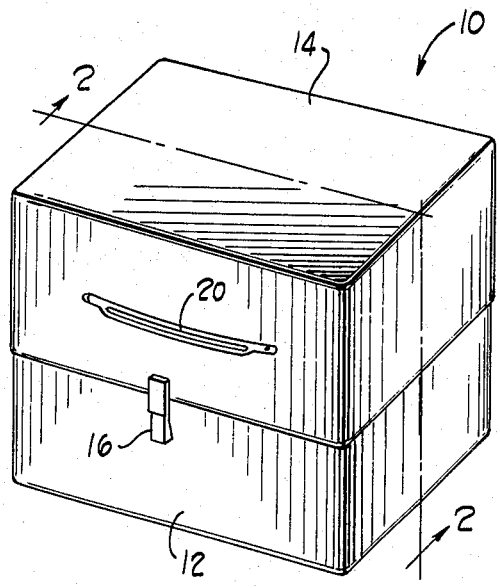
FIG. 1 is a perspective view of a carrier according to the invention.

A carrier 10 according to the invention is shown in FIG. 1. The carrier includes an interface member 12 engageable with film processing machinery (not shown). Reference is made to the Mixer Patent for a specific showing of the relationship between the interface member and the machinery. The interface member 12 substantially is identical to the interface member (or section 47*a*) illustrated in the Mixer Patent and both interface members perform the same function, namely, they rest atop film processing machinery and provide a means by which film processing chemicals may be held in readiness for discharge into the machinery.

The carrier 10 includes a cover 14 adapted to engage the interface member 12 in an interlocking relationship. The cover includes snap latches 16, and the interface member includes pins 18 to secure the interface member and the cover together. The latches and pins on opposite sides are offset a predetermined distance from a longitudinal axis (indicated by the dotted line 19 in FIGS. 3 and 4) of the interface member and the cover. The latches are displaced as shown for one type of chemical and are each displaced on the other side of the axis for another type of chemical. This assures that a cover for a fixer carrier cannot be interchanged with a cover for a developer carrier.

Carrying handles 20 are secured to each long side of the cover and the interface member includes a pair of diagonally spaced, projecting pins 22, as well as a plurality of longitudinally spaced apertures 24. The pins for a developer interface member and the pins for a fixer interface member are located such that the interface members can be used only with their respective film processing mechanisms. The Mixer Patent includes a specific description of these features.

Figure 2:
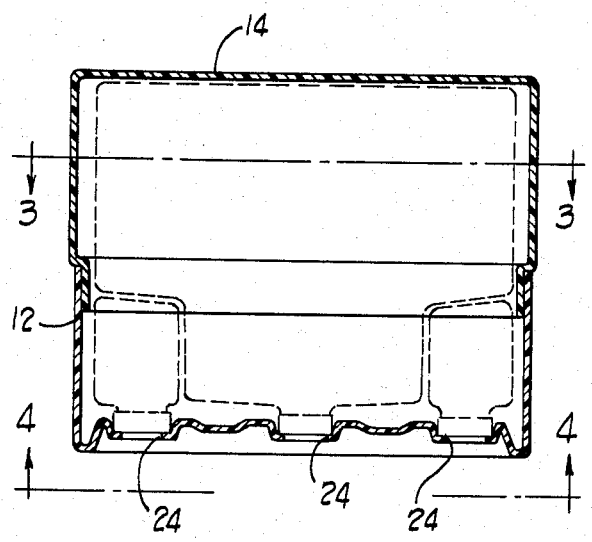
FIG. 2 is a view taken along line 2—2 of FIG. 1 showing a container in place within the carrier.
Figure 3:
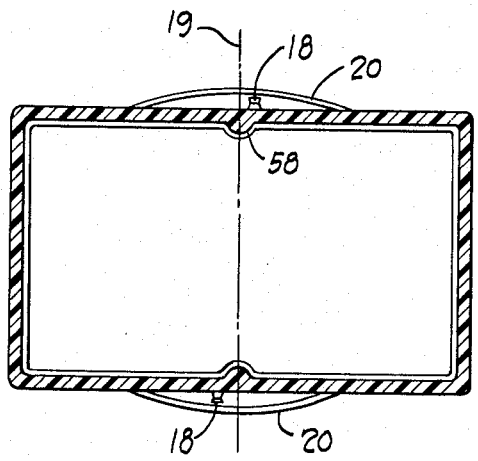
FIGS. 3 and 4 are views taken along lines 3—3 and 4—4, respectively, of FIG. 2.
Figure 4:
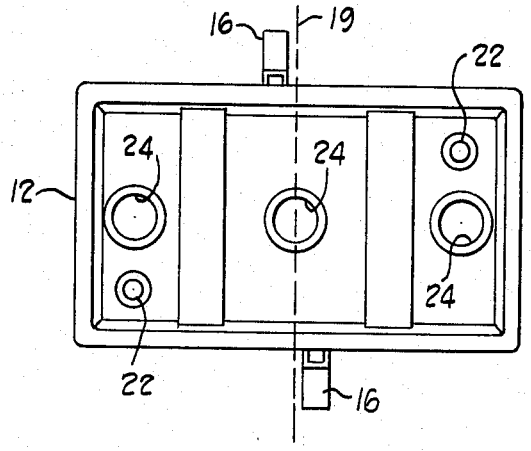
Figure 5:
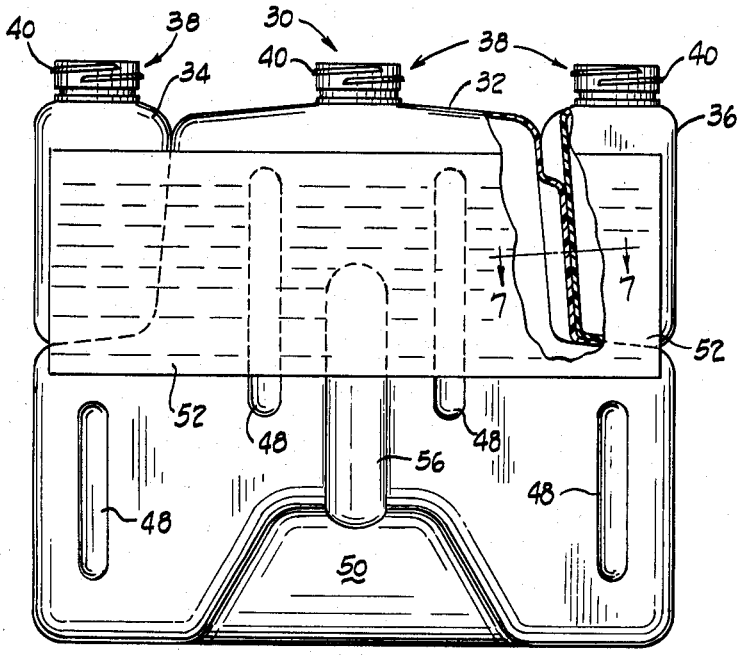
FIG. 5 is a side view, partly in section, of a container according to the invention.

A container 30 according to this invention is shown standing alone in FIG. 5 and assembled in place inside the volume defined by a locked cover 14 and interface member 12 in FIGS. 2 and 3. The container 30 is a composite, unitary structure comprised of plurality of individual, interlocking bottles 32, 34, 36. When the bottles are in place and locked together, the exterior shape of the assembled container generally is that of a rectangular prism.

Each bottle includes an opening 38 through which the bottles may be charged with chemicals and through which chemicals may be dispensed. Each opening 38 is comprised of a threaded neck 40 extending outwardly of a generally planar surface of the bottle. A pierceable septum (not shown) or a cap (not shown), or both, may be fitted to each neck 40 to seal the container contents.

In the assembled position shown in FIG. 5, the openings are disposed in approximately the same plane and, as shown in FIG. 2, are alignable with the openings 24 included as part of the interface member. It is expected that the film processing machinery will include openings complementary to the necks 40 and the openings 24 so that, upon inverting a loaded carrier onto the machinery, the container contents may be discharged into the machinery by piercing or other rupturing of the septa. This construction permits the chemicals to be dispensed with little danger of spilling.

Figure 8:
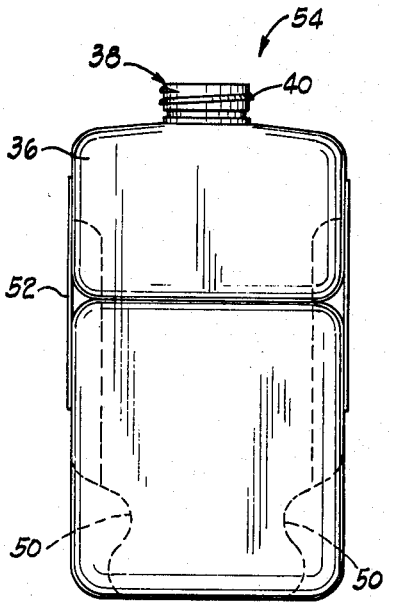
FIG. 8 is an end view of a container similar to the container of FIG. 5.
Figure 6:
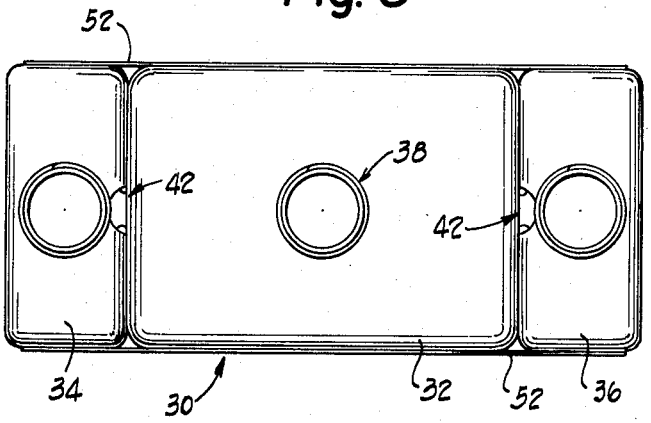
FIG. 6 is a plan view of the container of FIG. 5.
Figure 7:
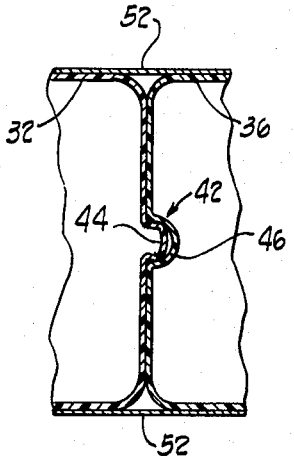
FIG. 7 is a view taken along line 7—7 of FIG. 5 showing in greater detail the interconnection between bottles.

The connection between bottles is provided by an interlocking mortice/tenon 42. Referring more particularly to FIG. 8, the mortice/tenon comprises a projecting, longitudinally extending portion 44 and a complementary, longitudinally extending, recessed portion 46. The portions 44, 46 are formed as an integral part of the respective bottles so that manufacturing expense is minimized. Assembly of the bottles also is particularly easy because the interlocking mortice/tenon readily is engaged. It is expected that the bottles will be formed of a lightweight, blow-molded plastic material and that the portions 44, 46 may be deformed sufficiently when the bottles are engaged to provide a tight, sure engagement between the bottles.

In order to strengthen the large bottle 32 so that a lightweight material can be used to form the bottle, a series of indented portions 48 are formed in the sides of the bottle. These indented portions serve as stiffening ribs and may be positioned as desired to perform this function.

The bottle 32 also includes indent portions 50 along opposite sides of the bottle and spaced from the opening 38, as seen best in FIGS. 5 and 8. The indented portions 50 permit the container to be gripped conveniently so that it can be maneuvered with little difficulty.

After the bottles 32, 34, 36 have been assembled, wrappers 52 may be adhered to a portion of the exterior surface of the container 30. Each wrapper 52 is comprised of paper or plastic having indicia on one side to identify the container contents, manufacturer, and so forth; on the other side, the wrapper may be coated with contact cement or similar material to permit the wrapper to stick to the bottles readily. By extending the wrappers across a portion of the interfaces between bottles, the bottles may be retained in place even more securely than with the mortice/tenon acting alone. If it is desired to reuse the bottles, the wrappers can be removed so that the bottles can be disassembled and returned to their appropriate assembly lines for cleaning, refilling and resealing.

A container 54 similar to the container 30 is shown in FIG. 8. The containers largely are identical and like reference numerals are carried over where appropriate. The principal difference between the container 54 and the container 30 is that the container 54 is not as tall as the container 30. Stated differently, the container 30 includes an exterior dimension greater than a corresponding exterior dimension of the container 54. Another difference is that the container 30 includes an open-ended groove 56 (FIG. 5) opening along an edge portion of the container, which edge portion is adapted to be engaged by the cover associated with the container 30. The container 54 lacks such a groove.

The foregoing construction, particularly the differences between the containers 30, 54, provides a foolproof container system for supplying different chemicals to film processing mechanisms. More specifically, the interface members 12 for the developer and fixer chemicals cannot be employed with the wrong film processing mechanism for reasons explained earlier and also explained in the Mixer Patent. Because the container 30 is taller than the container 54 (and assuming that the container 30 holds developer chemicals), the fixer cover associated with the shorter container cannot be employed with the developer interface member because the latches 16 and the pins 18 cannot be engaged when the taller developer container 30 is in place. Even without the developer container in place, the covers and interface members cannot be interchanged because the latches 16 and the pins 18 for the respective covers and members are offset on opposite sides of a longitudinal axis.

The groove 56 in the developer container 30 forms a first discriminating means which permits the carrier covers to distinguish between the containers 30, 54. A second discriminating means comprises a projecting portion 58 (FIG. 3) included as part of the cover associated with the developer container 30. By this construction, then, the developer container can be fitted into the volume defined by the developer cover and the developer interface member because the groove and projecting portion slidably will engage each other to permit the container 30 to be nested inside the cover. However, since the container 54 is as wide as the container 30 but lacks the groove 56, the shorter fixer container cannot be fitted inside the developer cover.

In use, it is expected that the fixer chemicals will require only two bottles to house the chemicals required for a proper fixer solution while the developer chemicals still require three bottles to house the developer chemicals necessary for a proper developer solution. Accordingly, the assembled fixer container 54 may form only the major portion of a rectangular prism.

By providing that each container can be employed only with a certain cover and that each cover in turn can be employed only with a certain interface member, it will be appreciated that a container system constructed according to the invention provides an effective, fool-proof technique for preventing a developer container from being used with a fixer carrier and vice versa. Further, by providing that the respective interface members can be employed only with the proper film processing machinery, it will be apparent that improper mixing cannot occur. It also will be appreciated that a container constructed according to the invention is exceedingly simple, lightweight and easy to manufacture. The individual bottles are susceptible to being blow-molded, which provides a significant manufacturing advantage, especially as regards formation of the interlocking mortise/tenon. Due to the exterior configuration of the assembled container, a maximum amount of chemical now can be stored in a minimum amount of space and with great convenience in stacking and handling.

Although the invention has been described with a certain degree of particularity, it will be appreciated that the present disclosure of the preferred embodiment has been made only by way of example. Various changes in the details of construction may be resorted to without departing from the true spirit and scope of the invention and it is intended to cover all such changes in the appended claims.

We claim:

1. A container system for supplying chemicals to film processing mechanisms, comprising first and second composite containers, the first composite container including a large bottle and two smaller bottles attached to it, the three bottles shaped such that when the bottles are interconnected the exterior shape of the container approximates a rectangular prism, the second composite container including a large bottle and a smaller bottle adapted to be interconnected, the two bottles shaped such that when the bottles are interconnected the exterior shape of the container approximates at least the major portion of a rectangular prism, the containers including means for discriminating therebetween, the discriminating means comprising an exterior dimension of the first composite container which is greater than a corresponding exterior dimension of the second composite container and a groove with at least one open end formed in one surface of the first composite container, the groove being adapted to receive a projection when the container is inserted into a receiving cavity.

2. The supply system of claim 1, wherein each bottle of both the first and second composite containers includes an opening for the discharge of chemical into the film processing mechanism, the openings of the bottles of each container being aligned in a common plane.

3. The supply system of claim 1, further including a separate carrier for each composite container, a receiving cavity being included as part of a carrier.

4. The supply system of claim 1, wherein the connection between individual bottles forming each container is made by an interlocking mortise/tenon and a wrapper is adhered to a portion of the exterior surface of the container, the wrapper extending across a portion of the interface between bottles to hold the bottles together securely.

5. A container system for dispensing film developer chemicals only into a film developer processing mechanism and for dispensing film fixer chemicals only into a film fixer processing mechanism, comprising:

(a) a developer chemical carrier assembly, including:

(i) a developer interface member operatively engageable only with the film developer processing mechanism, the developer interface member having at least one opening for the discharge of film developer chemicals into the film developer processing mechanism;

(ii) a unitary developer container for holding at least two film developer chemicals apart from each other, the developer container engageable with the developer interface member; and (iii) a developer cover operatively engageable only with the developer interface member, the developer cover configured internally to hold the developer container securely in place inside a volume defined by the assembled developer interface member and cover; and (b) a fixer chemical carrier assembly, the fixer assembly including:

(i) a fixer interface member operatively engageable only with the film fixer processing mechanism, the fixer interface member having at least one opening for the discharge of film fixer chemicals into the film fixer processing mechanism;

(ii) a unitary fixer container for holding at least two film fixer chemicals apart from each other, the fixer container engageable with the fixer interface member; and (iii) a fixer cover operatively engageable only with the fixer interface member, the fixer cover configured internally to hold the fixer container securely in place inside a volume defined by the assembled fixer interface member and cover;

the developer and fixer containers being of the same overall configuration, except that:

(a) one container has a greater exterior dimension than the other container so that the cover associated with the container lacking the greater exterior dimension cannot operatively receive the container having the greater exterior dimension;

(b) the container having the greater exterior dimension includes first discriminating means not included with the other container; and (c) the cover associated with the container having the greater exterior dimension includes second discriminating means, the second discriminating means engageable with the first discriminating means whereby the containers can be used only with their respective interface members and covers.

6. The container system of claim 5, wherein the first discriminating means comprises a relieved portion and the second discriminating means comprises a projecting portion.

7. A container system for dispensing film developer chemicals only into a film developer processing mechanism and for dispensing film fixer chemicals only into a film fixer processing mechanism, comprising:

(a) a developer chemical carrier assembly, including:

(i) a developer interface member operatively engageable only with the film developer processing mechanism, the developer interface member having at least one opening for the discharge of film developer chemicals into the film developer processing mechanism;

(ii) a unitary developer container for holding at least two film developer chemicals apart from each other, the developer container engageable with the developer interface member; and (iii) a developer cover operatively engageable only with the developer interface member, the developer cover configured internally to hold the developer container securely in place inside a volume defined by the assembled developer interface member and cover; and (b) a fixer chemical carrier assembly, the fixer assembly including:

(i) a fixer interface member operatively engageable only with the film fixer processing mechanism, the fixer interface member having at least one opening for the discharge of film fixer chemicals into the film fixer processing mechanism;

(ii) a unitary fixer container for holding at least two film fixer chemicals apart from each other, the fixer container engageable with the fixer interface member; and (iii) a fixer cover operatively engageable only with the fixer interface member, the fixer cover configured internally to hold the fixer container securely in place inside a volume defined by the assembled fixer interface member and cover;

the developer container having at least one exterior dimension greater than the fixer container so that the developer container cannot be received by the volume defined by the fixer cover, and the developer container and the developer cover including matable means configured such that the developer cover can be attached to the developer interface member with only the developer container and not the fixer container, in place.

8. The container system of claim 7, wherein the matable means comprises:

(a) a groove in the developer container, the groove opening along an edge portion of the container engaged by the developer cover; and (b) a projecting portion in the developer cover, the projecting portion engageable with the groove upon displacement of the developer container into the volume defined by the developer cover.

* * * * *